United States Patent [19]

Hechinger

[11] 4,208,073

[45] Jun. 17, 1980

[54] WHEEL FOR SKATEBOARDS AND ROLLER SKATES

[76] Inventor: Al Hechinger, P.O. Box 66373, Los Angeles, Calif. 90066

[21] Appl. No.: 890,392

[22] Filed: Mar. 27, 1978

[51] Int. Cl.[2] ..... A63C 17/22

[52] U.S. Cl. ..... 301/5.3; 152/323

[58] Field of Search ..... 301/5.3, 5.7, 63 PN; 152/7, 301, 302, 323, 324; 280/87.04 A; 16/45–47

[56] References Cited

U.S. PATENT DOCUMENTS

| | | | |
|---|---|---|---|
| 2,878,071 | 3/1959 | Fowlkes | 301/5.3 |
| 3,048,447 | 8/1962 | Klint | 301/63 PN |
| 3,387,894 | 6/1968 | Louik | 301/63 PN |
| 3,992,025 | 11/1976 | Amelio | 301/5.7 X |
| 4,128,254 | 12/1978 | Powell | 301/63 PN |

FOREIGN PATENT DOCUMENTS

| | | | |
|---|---|---|---|
| 54394 | 3/1943 | Netherlands | 152/301 |
| 229745 | 2/1925 | United Kingdom | 301/5.7 |
| 755123 | 8/1956 | United Kingdom | 301/5.7 |

OTHER PUBLICATIONS

Emotion Wheel Advertisement; "Skateboarder" Magazine; Jan. 1978; vol. 4, No. 6.

*Primary Examiner*—Charles A. Marmor
*Attorney, Agent, or Firm*—Ralph B. Pastoriza

[57] ABSTRACT

The wheel is made up of first and second annular wheel portions comprised respectively of low and high coefficient of friction materials; for example, urethane and rubber. These annular portions are bonded together in coaxial relationship. The outer peripheral edges are provided with a calculated radius to aid the transition of a skateboard or roller skate on which the wheel is mounted over surfaces encountered in pools, bowls, skateboard or roller skate parks, ground ridges and the like. Further, the first annular wheel portion of urethane includes a hub coaxially extending within the second annular portion of rubber, the radius of the outer peripheral edge of the second annular portion comprising the rubber curving inwardly to cover the outer peripheral edge portion of the hub to thereby inhibit separation of the first and second wheel portions.

4 Claims, 5 Drawing Figures

WHEEL FOR SKATEBOARDS AND ROLLER SKATES

This invention relates generally to wheels for skateboards and roller skates and more particularly to an improved wheel construction for providing increased reliability and control when used on skateboards or roller skates.

While the wheel of this invention can be used on either skateboards or roller skates, for purposes of setting forth a specific example, the wheel will be described in conjunction with a skateboard.

BACKGROUND OF THE INVENTION

It is known to fabricate skateboard wheels from different types of material. For example, semi-hard rubber will provide a comfortable, shock-absorbing wheel structure and a relatively high coefficient of friction with the ground to provide good traction. On the other hand, the rubber itself tends to wear out relatively quickly and the high coefficient of friction results in a relatively low speed wheel.

An alternative known in the art is to fabricate the skateboard wheel from solid plastic such as urethane. These wheels have a relatively low coefficient of friction with the ground and accordingly provide for high speed and as a consequence have gained considerable popularity in recent years. On the other hand, the relatively low coefficient of friction results in poor traction which can be serious in lateral directions. The poor traction characteristics can be overcome to some extent by making the plastic such as urethane softer but by so increasing the traction, the speed of the wheels is decreased. Essentially, while the plastic or urethane type wheels are still in wide use, they all represent a compromise between speed and traction.

Even more recently, it has been proposed in the prior art to combine both the urethane and rubber in a single composite skateboard wheel thereby gaining certain advantages inherent in each material. In such known composite type wheels, a first annular portion of the wheel is made of urethane and a second annular portion of rubber bonded with the urethane. A major problem associated with such type of composite skateboard wheels has been in bonding the materials together. More particularly, there is a tendency for the rubber to separate from the urethane. A result of such separation is a greatly reduced speed, uneven wear and a rougher ride due to the tendency of the rubber material to deform and stretch.

Another problem associated not only with composite type skateboard wheels as described above, but with skateboard wheels in general is the relatively sharp peripheral edges of the wheel resulting from the manufacturing operation. Thus, the ground contacting portion of the wheel extends the entire distance of the overall width of the wheel, there being defined essentially a right angle at the inner and outer peripheral edges of the ground contacting portion with the opposite faces of the wheel. As a consequence, transition of a skateboard upon which the wheel is mounted over a ground ridge running at a very small acute angle; that is, almost parallel to the direction of motion of the skateboard, or over specially designed ridges in skating surfaces, is difficult and dangerous. Moreover, the sharp or extremely small radiused peripheral edges, if any, of such wheels results in chipping and uneven wearing of the urethane and/or rubber materials. Such chipping in the case of rubber results in rapid deterioration.

BRIEF DESCRIPTION OF THE PRESENT INVENTION

Bearing the foregoing considerations in mind, the present invention contemplates the provision of an improved skateboard or roller skate wheel of the composite type including a material with a first given coefficient of friction such as urethane and a material with a second given coefficient of friction higher than said first given coefficient of friction such as rubber but so constructed that the above discussed problems are essentially overcome.

The most suitable materials known to the inventors at the present state of the art for providing low coefficient and high coefficient portions making up the wheel are urethane and rubber respectively and for convenience in describing the present invention, these terms will be used throughout this specification. It is to be understood, however, that the invention is not to be deemed as limited to the specific materials of urethane and rubber but only to materials having the desired low and high coefficients of friction respectively.

Briefly, the wheel of this invention thus includes both low and high coefficient of friction materials relative to each other such as urethane and rubber portions contacting the ground so that the advantages of the shock absorbing characteristics and high friction of the rubber and the low friction characteristics of the urethane can be realized. Moreover, the fabrication of the wheel is such that the urethane portion includes an inner hub extending coaxially within the rubber portion for receiving the wheel axle, the outer peripheral edge of the rubber portion extending in a radial and axial inward direction to completely cover the outer end of the urethane hub portion coaxially received within the rubber to thereby inhibit separation of the portions. Additionally, the outer peripheral edge of the rubber portion and, in the preferred embodiment, the outer peripheral edge of the urethane portion, are radiused by a calculated amount to result in greater control of a skateboard or roller skate on which the wheel is mounted in passing over ridges running almost parallel to the direction of motion of the skateboard or roller skate.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
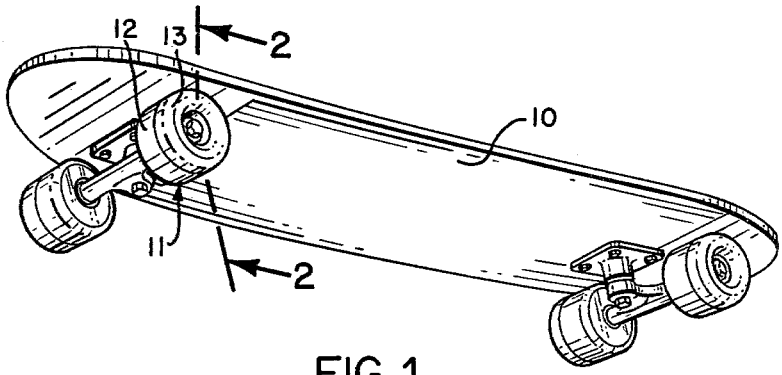
FIG. 1 is a perspective view of the underside of a skateboard upon which wheels in accord with the present invention have been mounted. Again, the skateboard is merely an example, the wheels being equally applicable to roller skates.

Referring first to FIG. 1 there is shown a skateboard 10 provided with wheels one of which is shown at 11. Each of these wheels is formed in accord with the present invention and since each is the same, a detailed description of one will suffice for all.

Basically, each of the wheels as shown for the wheel 11 in FIG. 1 includes a first annular portion having a first given coefficient of friction material such as urethane 12 and a second annular wheel portion having a second given coefficient of friction material such as rubber material 13 higher than said first given coefficient of friction. The second annular wheel portion is coaxial with and bonded to the first portion. When mounted on the skateboard as illustrated in FIG. 1, the second annular rubber portions of the wheels are on the outer side and the urethane portions on the inner side. Referring now to the cross section of FIG. 2, the overall diameter of the wheel is designated by the letter D and the overall width by the letter W. Each of the outer peripheral edges of the first and second portions 12 and 13 is radiused an amount R as indicated at 14 and 15. This radius is between 0.1 to 0.3 of the referred to given width W. In the preferred embodiment, the radius is about 0.2 of the given width.

In addition to the above-described radiusing of the outer peripheral edges, the first annular portion 12 includes a hub 16 extending coaxially into the second annular portion 13 as shown. In accord with an important feature of this invention, the outer peripheral edge of the second portion 13 continues from the radius 15 in a radial and axial inward direction to cover the outer peripheral edge of the hub 16 thereby inhibiting separation of the first and second portions.

Figure 2:
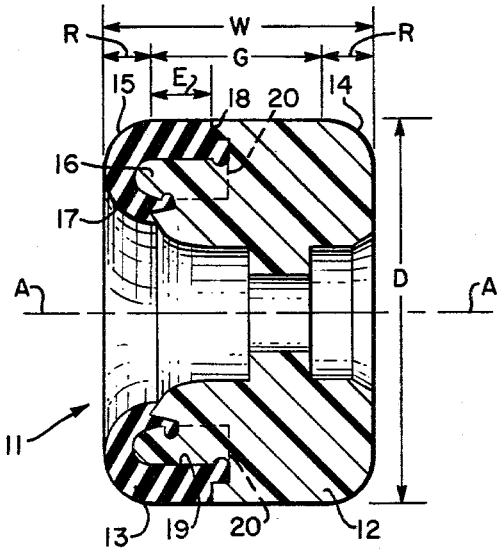
FIG. 2 is a cross section of a wheel taken in the direction of the arrows 2—2 of FIG. 1.

Still referring to FIG. 2, the non-radiused ground contacting extent of the second portion 13 in the direction of the width W, and designated by the letter E is from 0.25 to 0.75 of the overall ground contacting extent of both said first and second portions. This latter ground contacting extent is designated by the letter G. In the preferred embodiment the ground contacting extent E is about 0.3 of the ground contacting extent G.

The radiusing of the outer peripheral edges to the extent indicated by the letter R and as described relative to the overall width is such that movement of a skateboard or roller skate upon which the wheel is mounted in transition over ground ridges running at acute angles to the direction of motion of the skateboard, or almost parallel thereto, is greatly aided. In other words, the radiused surface permits the transition of the skateboard over the ridge or onto a different level of ground to take place with less risk of accident than would be the case were there not provided any radius or only a very small radius relative to the overall width of the wheel. Radiusing of the outer peripheral edge of the first annular portion forming the inside of the wheel as described in FIG. 2 also aids in this transition after the wheels along one longitudinal side of the skateboard have already traversed the transition and the wheels on the other longitudinal side are moving over the ridge or new level surface.

Figure 3:
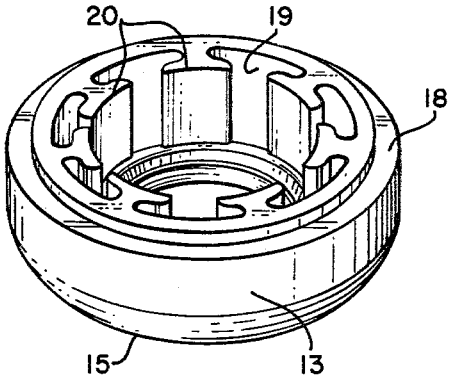
FIG. 3 is a top perspective view of a second portion of the wheel separated from the first portion as it would appear during a step in the manufacture of the wheel.

Referring now to FIG. 3, there is shown the second annular portion 13 comprised of rubber material after the same has been molded but before the first annular urethane portion has been formed. As shown in FIG. 3, the outer peripheral engaging portion includes an annular step 18 which will increase the bonding area with the urethane at the meeting point of the first and second annular portions. Further, the interior wall 19 of the second annular portion is provided with projections 20 directed radially inwardly and flaring circumferentially outwardly so that when liquid urethane is poured into the rubber portion, these projections will project into the formed hub portion 16 described in FIG. 2 of the first annular urethane portion. It will be understood, of course, that appropriate mold members (not shown) are provided during the pouring operation.

Figure 4:
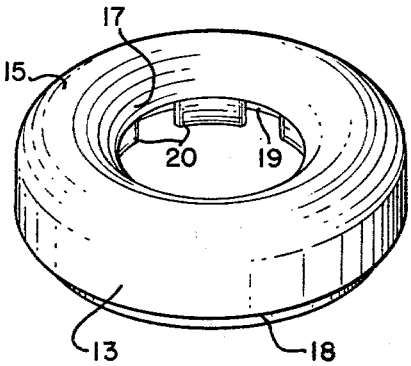
FIG. 4 is a bottom perspective view of the second portion of the wheel shown in FIG. 3; and, FIG. 5 is a plan view of the wheel portion shown in FIG. 3.

FIG. 4 is a perspective view of the second annular portion 13 illustrated in FIG. 3 but showing the outer radiused edge and radial inward directed portion 17 not visible in FIG. 3.

Figure 5:
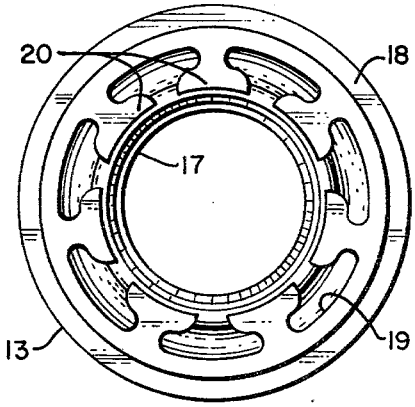

The plan view of FIG. 5 illustrates the projections 20 in greater detail wherein it will be noted that they extend all about the interior periphery of the wall 19. These projections, of course, will lock the first and second portions against relative rotation to each other.

While the diameter D of the wheel may vary from 0.5 to three times the overall width W, in the preferred embodiment of the wheel as shown in the drawings, the diameter approaches one and one half times this width.

With skateboard or roller skate wheels fabricated in accord with the teachings of this invention, not only does the composite structure provide for extremely good lateral traction and appropriate shock absorbing as well as relatively low coefficient of friction, but the radiused outer edges result in greater control when passing over transitions as described. Further, the outer peripheral radiused edges of the first and second annular members inhibits chipping of these portions of the members. Finally, the radial and inward curving of the second annular portion about the peripheral end of the hub fully protects this portion of the hub and inhibits separation in this area.

From all of the foregoing, it will thus be evident that the present invention has provided a greatly improved wheel for skateboards and roller skates wherein certain problems associated with prior art wheels have been avoided or at the very minimum, substantially reduced.

We claim:

1. A wheel for skateboards and roller skates, said wheel having a given overall diameter and width as measured in directions respectively normal and parallel to the axis of the wheel and including in combination:

(a) a first annular wheel portion of material having a first given coefficient of friction; and (b) a second annular wheel portion of material having a second given coefficient of friction higher than said first given coefficient of friction, said second annular wheel portion being coaxial with and bonded to said first portion, said first portion having a reduced diameter hub extending axially within said second portion, the interior of said second annular portion receiving said hub including projections extending radially inwardly and circumferentially into said hub to rotationally lock said second annular wheel portion to said first annular wheel portion, the outer peripheral edges of said first and second portions each having a radius of from 0.1 to 0.3 of said given width, the radius of the outer peripheral edge of said second portion constituting the edge on the outer axial end of the wheel when mounted on a skateboard or roller skate, continuing in a radial and axial inward direction to cover the outer peripheral edge of said hub to thereby inhibit separation of the first and second portions, the non-radiused ground contacting extent of said second portion in the width direction being from 0.25 to 0.75 to the overall ground contacting extent of both said first and second portions, the outer radiused edges aiding movement of a skateboard or roller skate upon which said wheel is mounted in transition over ground ridges running at acute angles to the direction of motion of said board.

2. A wheel according to claim 1, in which said radius is about 0.2 of said given width and the extent of said non-radiused ground contacting portion is about 0.3 of said ground contacting extent of both said first and second portions.

3. A wheel according to claim 2, in which said given overall diameter is from 0.5 to three times said given overall width.

4. A wheel according to claim 3, in which said material having a first given coefficient of friction constitutes urethane and said material having a second given coefficient of friction constitutes rubber.

* * * * *